US009105154B2

(12) United States Patent
Jones

(10) Patent No.: US 9,105,154 B2
(45) Date of Patent: Aug. 11, 2015

(54) GIFT EXCHANGE AND TRADING GAME

(71) Applicant: Robert Warren Jones, San Antonio, TX (US)

(72) Inventor: Robert Warren Jones, San Antonio, TX (US)

( * ) Notice: Subject to any disclaimer, the term of this patent is extended or adjusted under 35 U.S.C. 154(b) by 0 days.

(21) Appl. No.: 13/910,853

(22) Filed: Jun. 5, 2013

(65) Prior Publication Data

US 2013/0267307 A1 Oct. 10, 2013

Related U.S. Application Data

(63) Continuation-in-part of application No. 13/208,339, filed on Aug. 12, 2011, now abandoned.

(51) Int. Cl.
*G07F 17/32* (2006.01)

(52) U.S. Cl.
CPC ..... *G07F 17/3253* (2013.01); *G07F 17/326* (2013.01)

(58) Field of Classification Search
CPC ..... G07F 17/3253
USPC ..... 273/292; 463/25
See application file for complete search history.

(56) References Cited

U.S. PATENT DOCUMENTS 7,543,819 B2 * 6/2009 Cox ..... 273/292

* cited by examiner

*Primary Examiner* — Michael Dennis
(74) *Attorney, Agent, or Firm* — Gunn, Lee & Cave, P.C.

(57) ABSTRACT

This game is a method performed by a processor for playing this item exchange game at a party or other gathering, for the purpose of enhancing the enjoyment and interaction of the participants while exchanging gifts or trading items. The game is played with virtual Turn Cards, Trader Cards, and Block Cards. The computer establishes the order of play to be displayed on the turn cards, and the trader cards instruct a player to select an unclaimed item, which concludes the turn. The trader card may instruct the player to take a turn card or claimed item from a Targeted Player. The Targeted Player may give up the turn card or claimed item, or may request a block card with instructions to prevent the player from taking the Targeted Player's turn card or claimed item. A turn is completed when a player selects an unclaimed item. The game ends when no unclaimed items remain.

6 Claims, 4 Drawing Sheets

15
Turn Card
2
1
3
1
One
4

20
Trader Card
6
5
Take an item or turn card from your best friend.
8
7

30
Block Card
10
9
You can block this trade if you balance on one foot longer than the Trader
12
11

GIFT EXCHANGE AND TRADING GAME

CROSS-REFERENCES TO RELATED APPLICATIONS

This is a continuation in part of U.S. patent application Ser. No. 13/208,339, filed Aug. 12, 2011, which is incorporated herein by reference.

STATEMENT REGARDING FEDERALLY SPONSORED RESEARCH OR DEVELOPMENT

Not applicable.

BACKGROUND OF THE INVENTION

1. Field of the Invention

The present invention relates to games as they pertain to gift exchanges among a plurality of players controlled and managed by a computer processor at a central location.

2. Description of the Related Art

The prior art for gift or item exchange games commonly known as White Elephant, Dirty Santa, Yankee Trader, or Chinese Gift Exchange allow for the taking of items from other players. The prior art is limited in the manner in which a player may protect his or her item or turn card. However, this game contains a method for increased participant interaction through various trading opportunities with Targeted Players, thus providing more interaction and participation.

BRIEF SUMMARY OF THE INVENTION

It is the object of this present invention to enhance the enjoyment and interaction of the participants while exchanging gifts or trading items. Persons knowledgeable in the art of playing this game will notice a similarity to a gift exchange game commonly known as White Elephant, Dirty Santa, Yankee Trader, or Chinese Gift Exchange; however, this parlor game contains a method for increased participant interaction and allows for remote play, customization, and increased efficiency through use of a personal computer or portable computing device such as a smartphone or tablet with connection to the Internet. Furthermore, the computer-based operation allows players to trade virtual items or credits to online retailers.

The preferred method of this invention calls for a host, ringmaster, and players. The number of players ranges from 6 to 24 and may include the host and ringmaster as players. Further, the host and ringmaster may be the same individual. Players may be individuals or groups depending on the rules the host provides. The host is the organizer of the game and determines the appropriate theme and the type of items or gifts the players should bring or purchase for the game. An item brought by a player remains undisclosed to the other players until the item is claimed through the game play. The ringmaster facilitates play and order of the game, and serves as the judge for actions that require a determination as to success or failure. Players are the person or team playing the game, with each player or team having access to a personal computer or portable computing device such as a smartphone or tablet device with an internet connection.

Game play begins with all players accessing the central location and joining the Internet-based game. After all players have joined and identified the items, the processor randomizes the players and displays the first player's trader card to the ringmaster. The ringmaster can accept the trader card, or reject and select a new trader card. After the ringmaster makes his decision and sends the input to the processor, the processor displays new trader card instructions to the ringmaster. Upon accepting the trader card, the instructions are displayed to the player, now referred to as the Trader. The Trader must comply with the instructions on the trader card. The trader card instructions are in the form of two categories. The first category requires the player to claim an item, which reveals the identity of the item to all players. After this action is taken, the turn is over and the processor notifies the next player of their turn.

The second category in the trader card instructions requires the Trader to take a turn card or item from another player based on a variety of different situations. This other player is referred to as the Targeted Player. In this situation, the Targeted Player has two options: (1) forfeit the item or turn card to the Trader; or (2) institute a block challenge. If the Targeted Player forfeits the turn card or item, the Targeted Player becomes the Trader. In the instance of a block challenge, the Targeted Player requests a block card from the processor. The instructions on the block card provide either a challenge to the Targeted Player or a competition with the Trader. If the Trader wins the block or challenge, then the Trader takes the Targeted Player's item or turn card. If the Targeted Player wins the block or challenge, the Targeted Player retains the item or turn card. The loser of the challenge or block continues the turn as the Trader. Depending on the choices made by the players and the outcome of the block challenges, the ringmaster will enter the necessary inputs to the processor and the processor will automatically determine which steps are necessary. Depending on the outcomes, the displays to all the players are updated in real time.

Once a Trader is determined, through forfeiture of the item or turn card, or through losing the challenge or block, the Trader then has three options. The Trader may take a turn card or item from another player, may request a trader card, or take an unclaimed item. The video displays these options, of which the Trader will select one, and the ringmaster will enter that option into the processor. The turn continues as described above.

The game ends once all players have claimed an item. In an alternative ending, once all the items are claimed, the player who opened the first item may return the item that the player is holding. If the player declines to do that, the game ends. If the player elects to return the item, the player may then take an item from another player; however, that Targeted Player may block the Trader. Play shall continue until the remaining unclaimed item is claimed. The ringmaster will make sure that all items have been claimed and will verify with the processor that each player is matched to the item they have claimed.

DETAILED DESCRIPTION OF THE INVENTION

In describing the preferred embodiment, it is necessary to define the individuals for operation of the game. The host is the individual who invites everyone to play according to the method described herein. The host may customize the game or select from pre-defined themes to fit the party and players. The ringmaster manages the game, guides the players, and ensures the orderly progression of each turn. As final arbiter of disputes, the ringmaster should be fair-minded and familiar with the rules. The players are the individuals playing the game, which may include the host and/or the ringmaster. The ringmaster and the host may be the same person. The preferred method is recommended for six to twenty-four players, ages 10 to 110. Larger groups enable more interaction among the players and increase the fun. Younger players may need assistance. The term "player" may also encompass a couple or a group of individuals playing as a team.

In the preferred embodiment, the method is played by exchanging or trading items, but the game can be played using anything tradable. For example, the host may select a particular source of items, or set a theme such as art, books, collectibles, food, games, garage sale items, household items, movies, party favors, prank or gag items, recipes, seasonal gifts, sports items, toys, traditional "white elephant" gifts, and the like. The host may set a price range or price limit for the items, or he may alert his guests that there is no price limit. In other situations, items may be in the form of credits to online retailers. In the preferred embodiment, the items or credits are wrapped or otherwise disguised from identification between the other players. If in the form of credits, the credits are not disclosed to the other players. Once an item is claimed, as will be disclosed herein, the item becomes known to all players.

Figure 1:
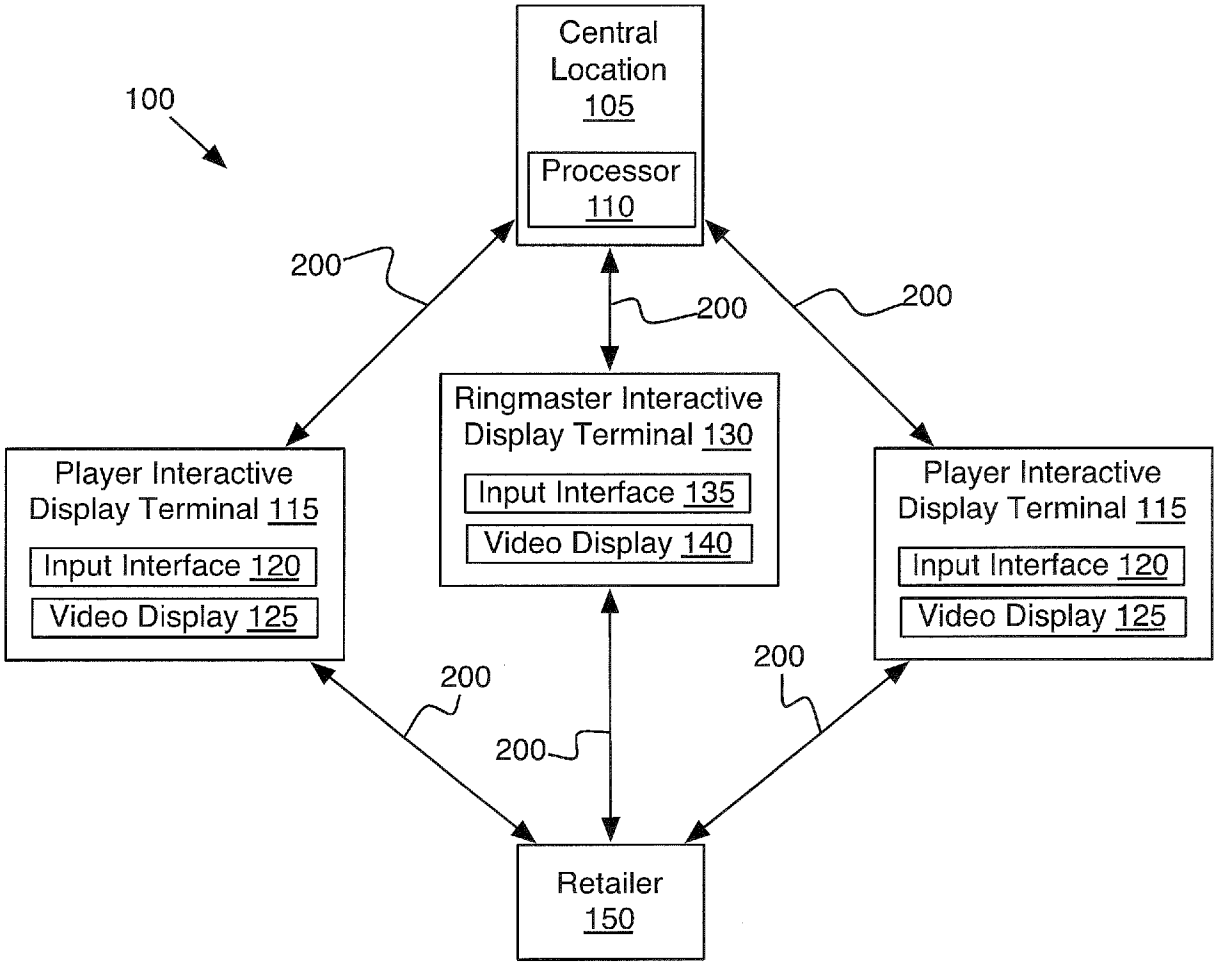
FIG. 1 is a block diagram of a system for which the invention may be executed and implemented.

FIG. 1 discloses a system 100 on which the gift exchange and trading game may be executed. The system includes a central location 105, a ringmaster interactive display terminal 130, and a plurality of player interactive display terminals 115. The central location 105 contains memory and a processor 110 that executes a software program that displays the video output to the terminals 115, 130, executes a method of play, and stores data pertaining to themes, player identifications, item identifications, and game flow. The central location 105 is operationally connected 200 to the ringmaster interactive display terminal 130 and player interactive display terminals 115. The connection 200 may occur through the Internet, other global network, or through a private network such as an intranet or a Local Area Network (LAN). The connection 200 may be wired or wireless, depending on the connection means. Furthermore, the ringmaster interactive display terminal 130 and player interactive display terminals 115 may be connected through a combination of methods, but not all ringmaster interactive display terminals 130 and player interactive display terminals 115 are required to be connected in the same manner.

Each player interactive display terminal 115 and ringmaster interactive display terminals 130 have an input interface 120, 135 and a video display 125, 140. In some instances, input interfaces 120, 135 and video displays 125, 140 may be the same on some devices such as touch screen tablets, touch screen laptop computers, and portable computing devices. In other instances, the input interface and video display will be separate on some devices such as traditional personal computers and some cellular communication devices. In some embodiments, the ringmaster interactive display terminal 130 and player interactive display terminals 115 will be operationally connected 200 to retailers 150.

In the preferred embodiment, the ringmaster interactive display terminal 130 and player interactive display terminals 115 are simply access points that connect via connection means 200 to the central location 105, and any device capable of connecting to the Internet and having an input interface and display is sufficient to operate the present method.

Figure 2:
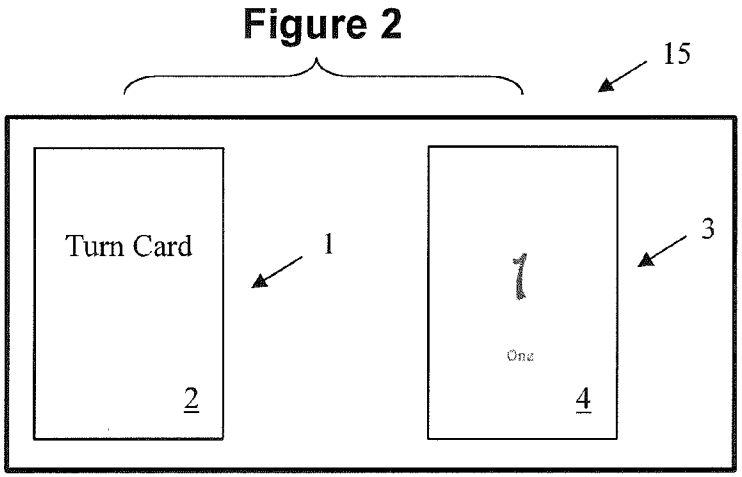
FIG. 2 discloses a turn card showing the front and back of the card.
Figure 3:
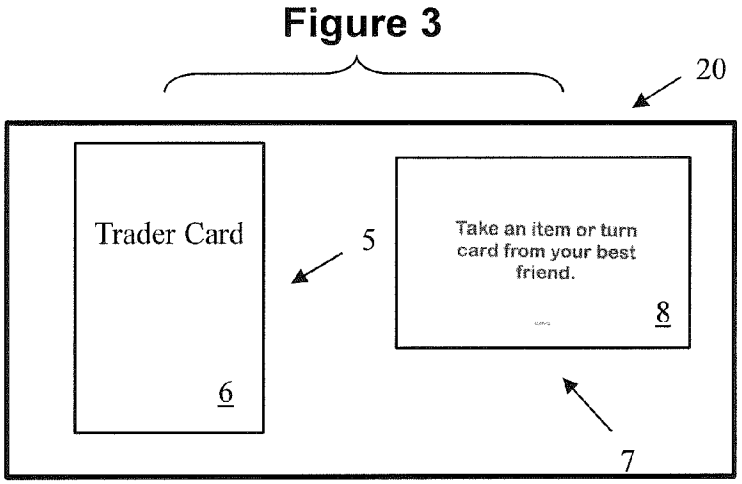
FIG. 3 discloses a trader card showing the front and back of the card.
Figure 4:
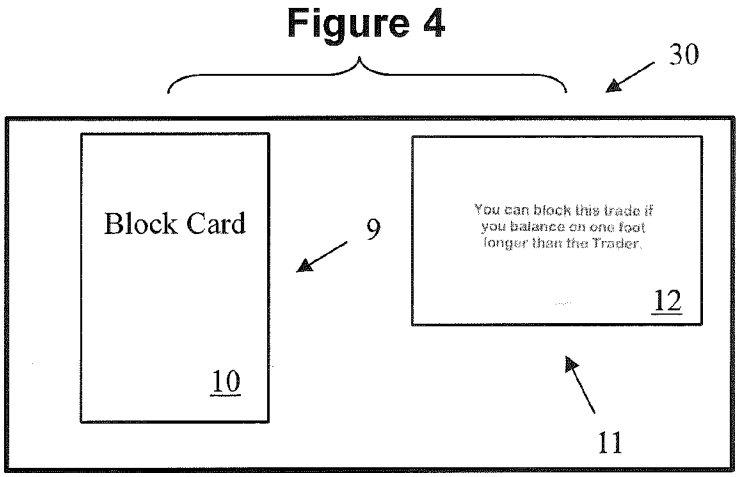
FIG. 4 discloses a block card showing the front and back of the card.

As shown in FIGS. 2-4, the present invention utilizes four cards: a turn card 15, trader card 20, block card 30, and a host card. These cards will be virtually represented on the video display 125, 140. In the preferred embodiment, the turn, trader, block, and host cards are virtually displayed on the video displays 125, 140 in a size and shape similar to poker or bridge playing cards. The format would also be similar to playing cards with art work on the back of each deck of cards and the turn card instructions 4, trader card instructions 8, or block card markings 12 on the corresponding faces of the cards. The ringmaster and each player may selectively choose which side of the card they want displayed on the video display 125, 140. For example, the player may touch the card on the screen, or select it through a click, to "flip" over the card.

FIG. 2 shows the preferred embodiment of the turn card 15 as seen on the video displays 125, 140. The turn card 15 comprises a turn card front 1 and a turn card back 3. On the turn card front 1 is turn card text 2, which identifies the card as a turn card 15. The turn card text 2 may come in a variety of different fonts and languages and may contain numerous graphical representations. On the turn card back 3 are turn card instructions 4 that are sequential numbers or any other system of order. The turn card 15 determines which player goes first and the sequence of play based on turn cards 15 throughout the game. The turn card instructions 4 are usually sequential numbers but may be anything that allows for a determination of order amongst all the players. The turn cards 15 are stored at the central location 105.

FIG. 3 shows the preferred embodiment of the trader card 20. The trader card 5 is displayed to the ringmaster first during each turn. The Trader is defined as the player trying to take a turn card 1 or an item from another player or selecting an unclaimed item. A Targeted Player is the player from whom the Trader is seeking to obtain a turn card 15 or item. The trader card 20 comprises a trader card front 5 and a trader card back 7. On the trader card front 5 is trader card text 6 which identifies the card as a trader card 20. The trader card text 6 may come in a variety of different fonts and languages and may contain numerous graphical representations. On the trader card back 7 are trader card instructions 8.

The trader card instructions 8 may come in a variety of different formats falling into three general categories: 1) taking an unclaimed item; 2) taking a claimed item from another player; or 3) taking a turn card 15 from another player. The trader card instructions 8 are stored at the central location 105 and may be supplemented or amended by future updates. The trader card instructions 8 may be related to a particular theme or randomly created. The trader cards 20 are stored at the central location 105 and may be grouped by themes.

Examples of trader card instructions 8 include, but are not limited to: open the largest remaining item; open the smallest remaining item; open the most unusual looking item; open the remaining package most likely wrapped by a guy; open or take the gift that was brought by the person to your right; open or take the gift that was brought by the person to your left; take an item or turn card from a person who is likely to be seen watching professional wrestling; take an item or turn card from the person most likely to appear on a beer commercial; take any item that has already been taken from another player; take an item or turn card from the person most likely to appear on "America's Most Wanted"; take an item or turn card from the person who lives farthest from your home; take an item or turn card from someone who looks or acts like your father; take an item or turn card from the person you would most like to date; take the last item that was taken from another player; take an item or turn card from someone of the opposite sex; take an item or turn card from the person who reminds you most of your favorite pet; take an item or turn card from the person who reminds you most of your favorite zoo animal; take an item or turn card from a person sporting a beard, mustache, or tattoo; take an item or turn card from someone on the opposite side of the room; take an item or turn card from the person you would most like to kiss; take an item or turn card from the person most likely to host a radio talk show; take an item or turn card from someone who looks most like your favorite celebrity; take an item or turn card from the person most likely to appear on a reality show; take an item or turn card from someone who would ride an elephant; take an item or turn card from someone who is wearing yellow or gold; take an item or turn card from the person most likely to date a rock star; take an item or turn card from someone wearing seasonal earrings; take an item or turn card from someone wearing blue; take an item or turn card from someone wearing red; take an item or turn card from the person who looks or acts most like your mother; take an item or turn card from the person most likely to become a priest, rabbi, or minister; trade for the item most likely to be found on an infomercial; take an item or turn card from the tallest person; take an item or turn card from the person you would most like to be with on a deserted island; take an item or turn card from the person you would least like to see in a swim suit; take an item or turn card from the person you would most like to share a canoe; take an item or turn card from the person you would most like to swap clothes; take an item or turn card from someone whose birthday is in the same month as yours; take an item or turn card from someone who plays a musical instrument; take an item or turn card from someone who wears glasses or contacts; take an item or turn card from someone who speaks more than one language; take an item or turn card from the youngest player; take an item or turn card from the person you would most like to see in a swimsuit; take an item or turn card from the person you've know the longest; take an item or turn card from the person most likely to be a model; take an item or turn card from the person who has the best singing voice; take an item or turn card from your best friend; take an item or turn card from the person you would most want to look like; take the item from the last player who opened one; take an item or turn card from the player 6 places to your right; take an item or turn card from the player 3 places to your left; take an item or turn card from the player 4 places to your right; take an item or turn card from the player 5 places to your left; take a turn card from the person holding the highest remaining number; and close your eyes, spin three times, and point (with your eyes still closed) to find your trading partner.

FIG. 4 shows the preferred embodiment of the block card 30. Block cards 30 provide players an opportunity to prevent a Trader from taking their turn card 15 or item. The block card 30 comprises a block card front 9 and a block card back 11. On the block card front 9 is block card text 10, which identifies the card as a block card 30. The block card text 10 may come in a variety of different fonts and languages and may contain numerous graphical representations. Printed on the block card back 11 are block card markings 12. The block card markings 12 are programmed into the software and may be supplemented or amended by future updates. The block card markings 12 may be related to a particular theme chosen by the host, related to the theme of trader cards, or may be randomly created. The block cards 30 are stored at the central location 105 and may be grouped by themes.

Examples of block card markings 12 include, but are not limited to: You can block this trade if you juggle three objects for ten seconds; You can block this trade if you sing the first verse of "America the Beautiful"; You can block this trade if you whistle "Dixie"; You can block this trade if you impersonate a famous movie character; You can block this trade if you beat your chest and yell like Tarzan; You can block this trade if you impersonate someone in the room; You can block this trade if you balance on one foot longer than the Trader; You can block this trade if you hop on one foot ten times without falling over; You can block this trade if you stand on your head; You can block this trade if you rub your tummy, pat your head, and chatter like Tarzan's chimpanzee, "Cheetah"; You can block this trade if you dance the "Macarena;" You can block this trade if you dance the "Chicken" and crow like a rooster; You can block this trade if you impersonate a zoo animal of the Trader's choice; You can block this trade if you dance the "Cotton Eyed Joe" with the Trader; You can block this trade if you kiss the trader and say, "No!" 1920's mobster style; You can block this trade if you and the Trader, lost and under pigmy attack, converse in questions only with the 1st non question statement losing; You can block this trade if you touch your toes without bending your knees; You can block this trade if you sing a song about something the Trader is wearing and a zoo animal; You can block this trade if you walk around the room with a book balanced on your head; You can block this trade if you, alternating with the Trader, can name more states and their capitols; You can block this trade if you count to ten in two languages other than your native tongue; You can block this trade if you dance the "Hula" while balancing a book on your head; You can block this trade if you sing a love song to the Trader; You can block this trade if you sing a silly song about a monkey, a baby elephant, and your mom; You can block this trade if you alternating with the Trader, can name more US presidents; You can block this trade if you beat the Trader at "Rock, Paper, Scissors"; You can block this trade if you tell a funny story about someone in the room; You can block this trade if you yodel; You can block this trade if you bark "Twinkle, Twinkle, Little Star"; You can block this trade if you whistle the "Andy Griffith Show" Theme Song; You can block this trade if you send the Trader to trade with the 4th player to your left; You can block this trade if you send the Trader to trade with the 5th player to your right; You can block this trade if you send the Trader to trade with the 6th player to your left; You can block this trade if you send the Trader to trade with the 7th player to your right; You can block this trade if you send the Trader to trade with any player of your choice; You can block this trade if you recite the alphabet backwards; You can block this trade if you tell an elephant joke; You can block this trade if you disclose your age and weight; You can block this trade if you balance a spoon on your nose; You can block this trade if you, alternating with the Trader, can name more "Beatles" song titles; You can block this trade if you send the Trader to the 3rd person on your left; You can block this trade if you show the Trader a coin, from your own pocket or purse, minted prior to the Trader's birth year; You can block this trade if you chug a drink of your choice with an 8 oz minimum; You can block this trade if you keep a "Poker Face" (no smiling) longer than the Trader; You can block this trade if you name the gifts from "The 12 Days of Christmas"; You can block this trade if you guess the Trader's shoe size; You can block this trade if you guess which gift the Trader brought; You can block this trade if you name five animals that begin with the last letter of the Trader's name; You can block this trade if you recite a nursery rhyme; You can block this trade if you name five "James Bond" movie titles; You can block this trade if you and the Trader converse in questions only about your wedding night with the first non-question statement losing; You can block this trade if you beat the Trader thumb wrestling; You can block this trade if you spell "Wild Trader Party" backwards; You can block this trade if you hold your breath for 30 seconds; You can block this trade if you touch your nose with your tongue; and You can block this trade if you raise each eye brow one at a time: R R L L R L R.

The host cards are trader and block cards 20, 30 on which the host may input his or her own trader card instructions 8 and/or block card markings 12 to personalize the game for his or her particular gaming group based on the age group, type of party, and/or theme. The ringmaster may create or modify the trader and block cards through the ringmaster interactive display terminal 130 that will update the central location 105 to allow for inclusion of the modified cards. The host cards can be customized when the game is not in progress and may also be saved for future use.

In an alternative embodiment, the turn, trader, host and block cards may be designed in a variety of shapes, sizes and displays. For example, the digital display of the trader card 20 may appear with the title "Trader Card" above the trader card instructions 8 and may specifically identify the player or team. Further, the turn, trader, host, and block cards may have a single view instead of being double-sided.

Figure 5:
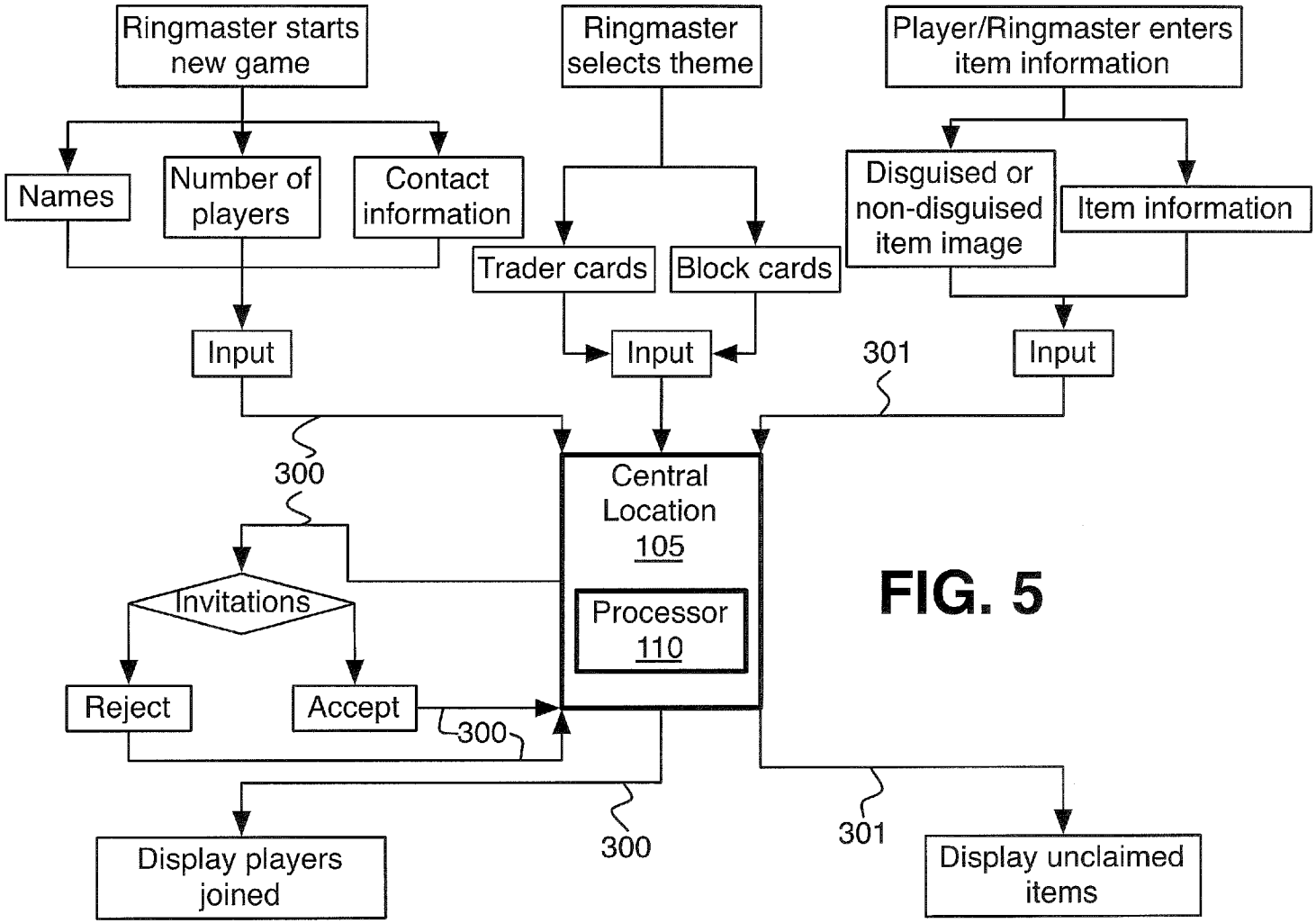
FIG. 5 discloses the preferred method of game setup.
Figure 6:
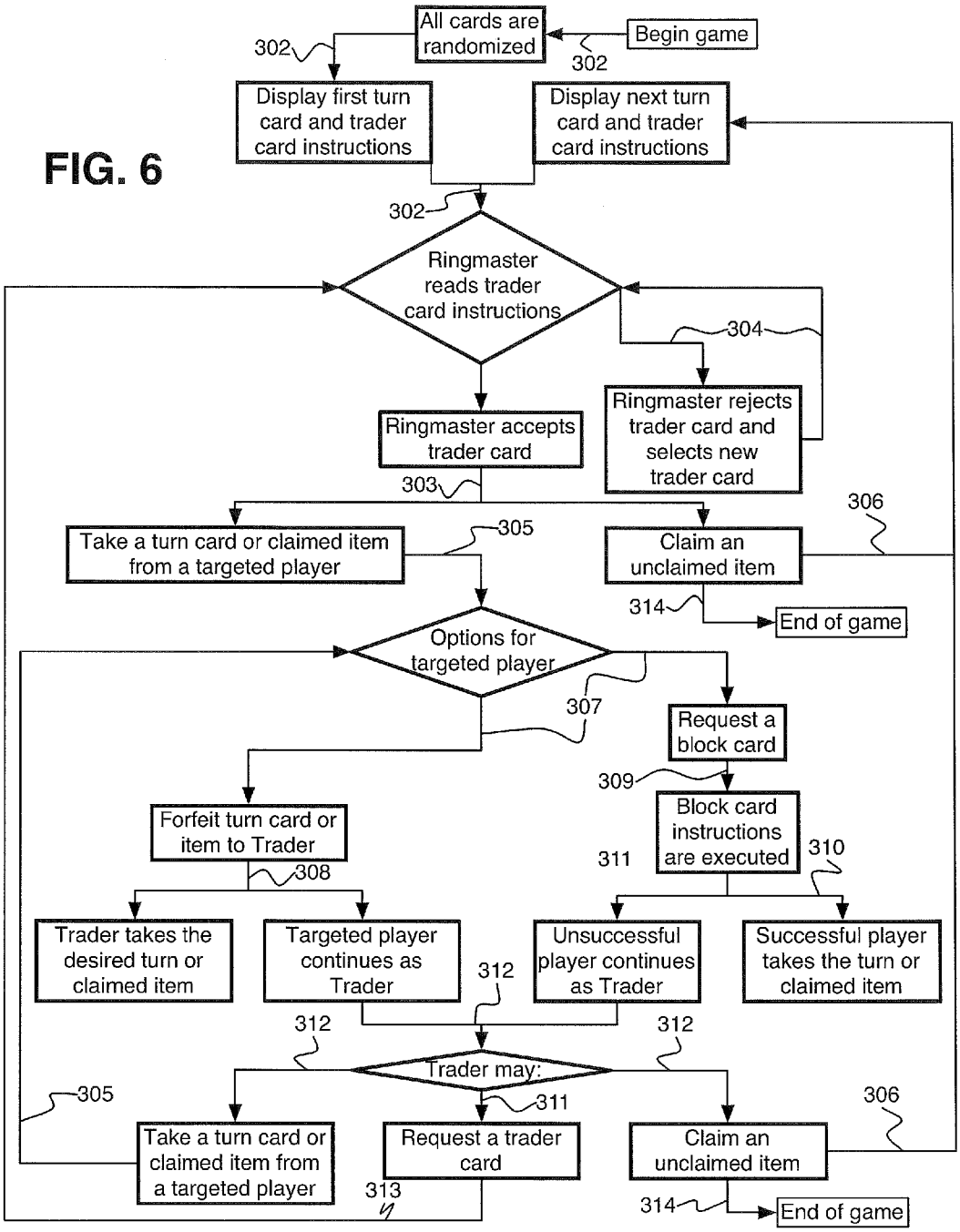
FIG. 6 discloses the preferred method of game play.

The preferred method of game setup of this invention is described in reference to FIG. 5. Prior to beginning the game, a host invites a predetermined number of players and determines a theme. The host provides information regarding the items or gifts that are to be brought, if any. A ringmaster is selected and is charged with the responsibility of setting up the game. To do so, the ringmaster utilizes the input interface 135 of the ringmaster interactive display terminal 130 to access the central location 105 and start a new game. The ringmaster creates the game, inputs the number of players, name of players, and contact information of players into the central location 105 wherein the central location 105 executes a process 300 through processor 110 and sends an invitation to the players through the player interactive display terminal 115 to join through email, text message, or other communication. This information includes instructions regarding accessing the central location and game, date, time, and potentially the type of item to bring. The player may then accept or reject the invitation through the input interface 120 of the player interactive display terminal 115 which is then sent to the central location 105. The central location 105 executes software through processor 110 interpreting the acceptance from the player by storing that information at the central location 105 and sending an output to all player interactive display terminals 115 and ringmaster interactive display terminal 130 that the specific player has joined. The processor 110 updates the interactive display terminals 115, 130 in real-time as the players accept or reject the invitations.

The ringmaster may set the game up in advance of the game to allow for sufficient opportunity for players to be joined. Alternatively, the ringmaster may create a unique identifier for the game at the central location 105 and supply that unique identifier to each prospective player. A prospective player, utilizing the player interactive display terminal 115, will then access the central location 105 through connection means 200 and input the unique identifier. Upon verification by the processor 110, the player will then enter the game.

Each player is required to bring an item as per the instructions of the ringmaster. If the gifts are physically brought, the gifts are wrapped so as to prevent disclosure. Players or the ringmaster, through the player interactive display terminals 115 and ringmaster interactive display terminal 130, upload information pertaining to the item brought, such information may be a photo of the disguised item, photo of the non-disguised item, or information regarding the item. Once this information is uploaded, a process 301 is executed by the processor 110 at central location 105. The player and/or ringmaster shall categorize the information as disguised information or non-disguised information 301 and input that into the central processor 105. The central processor 105 executes the process 301 through processor 110 and assigns a unique identifier to each item inputted by the player and/or ringmaster and stores information as disguised or non-disguised. Disguised item information shall be displayed when the item is unclaimed as disclosed herein and non-disguised information shall be displayed when the item becomes claimed as disclosed herein. As players and the ringmaster upload information before the game start, the processor 110 stores that information at the central location 105 and updates the interactive display terminals 115, 130 in real-time to show an item has been brought.

Players may also bring gifts by purchasing from an online retailer 150. In this example, a player utilizing the player interactive display terminal 115, will access an online retailer 150 through connection means 200 and purchase an item or purchase a type of an item. Confirmation of the purchase is then sent from the player interactive display terminal 115 to the central location 105 where the information is stored. A player may buy a specific item from the online retailer or buy a gift card or credits for use. This information is processed by the processor 110 and the player is given credit for a gift just as described above. As players claim the items, all players can view the non-disguised information for each claimed item through their interactive display terminals 115, 130.

Prior to beginning play, the ringmaster chooses the theme of the game by accessing the central location 105 and selecting a predetermined set of trader cards 20 and block cards 30. Once selected, the central location 105 assigns the themed trader cards 20 and block cards 30 to the specific game created by the ringmaster. The ringmaster may then create additional trader cards 20 and block cards 30 or remove certain trader card instructions or block card instructions as the ringmaster sees fit. The processor 110 executes these changes and stores the modification at the central location 105 for duration of the game. As will be described herein, as the processor 110 executes actions of the game, the processor 110 randomly selects trader cards 20 and block cards 30 from the ringmaster-created set.

The ringmaster stops player input to the processor 110 when it is time to begin the game. Once the ringmaster inputs the start of the game to the central location 105, a process 302 is executed by the processor 110 at central location 105. The processor 110 randomizes the turn cards 15, trader cards 20, and block cards 30. The processor 110 randomizes the trader cards 20 and the block cards 30 from the preselected cards, which is stored at the central location 105. The trader cards 20 are randomized so that each unique trader card 20 may only be used once until all trader cards 20 have been used. The block cards 30 are randomized so that each unique block card 30 may only be used once until all block cards 30 have been used. Use does not include trader cards rejected by the ringmaster.

The processor 110 assigns a unique turn card 15 to each player, which is stored in the central location 105 for the duration of the game. The processor 110 sends the unique turn card 15 via connection means 200 to each unique player interactive display terminal 115. Players are instructed to keep the turn card 15 hidden so that each player will not know when another player's turn is up. If the ringmaster is participating as a player, then the order of players is kept secret. If the ringmaster is not a player, then the processor 110 may also output the order of players to the video display 140 of the ringmaster interactive display terminal 130. The processor 110 then sends notification to all players and ringmaster through the video displays 125, 140, via connection means 200, as to the player with the turn card 15 that designates the first to play. This player becomes the Trader.

The processor 110 then selects the first trader card 20 and sends the trader card 20 to the ringmaster interactive display terminal 130. The ringmaster accepts or rejects the trader card 20 on the ringmaster interactive display terminal 130 through input interface 135, which communicates via connection means 200 to the central location 105. If the ringmaster rejects the trader card 20, then a process 304 is executed by the processor 110 at the central location 105 and a new trader card 20 is sent to the ringmaster interactive display terminal 130. If the ringmaster accepts the trader card 20, then a process 303 is executed by the processor 110 at the central location 105 and the trader card 20 is sent to all player interactive display terminals 115. The player interactive display terminal 115 corresponding to the Trader, as determined above, may utilize the input interface 120 to decide on which course of action to take based on the trader card instructions 8. The trader card instructions 8 are comprised of two types of actions: 1) take a turn card 15 or claimed item from a Targeted Player; or 2) claim an unclaimed item.

A Trader claims an unclaimed item by identifying the desired unclaimed item as seen on the video display 125 of the Trader's player interactive display terminal 115 through the input interface 120. Once the central location 105 receives the Trader's input via connection means 200, a process 306 is executed by the processor 110 at central location 105. The processor 110 reveals non-disguised information related to the formerly unclaimed item to all players and the ringmaster through the video displays 125, 140. The processor 110 further updates the players and ringmaster to show that the player, or Trader, has claimed this particular item. Upon selection of the unclaimed item, the turn automatically ends and the processor 110 identifies the next Trader based on the previously determined order of turn cards 15 through updating the video displays 125, 140.

If the trader card instructions 8 require the Trader to take a turn card 15 or a claimed item from a Targeted Player, then the ringmaster identifies the Targeted Player through the input interface 135 via connection means 200 to the processor 110. Once the Targeted Player is identified by the ringmaster, a process 305 is executed by the processor 110 at central location 105. The processor 110 then displays the identity of the Targeted Player to all interactive display terminals 115, 130 via connection means 200.

Once the identification of the Targeted Player is completed, a process 307 is executed by the processor 110 at central location 105. The processor 110 sends an output to all interactive display terminals 115, 130, through connection means 200, which presents two options: 1) the Targeted Player may forfeit his turn card or claimed item, if any, to the Trader; or 2) request a block card 30 from the processor 110.

If the Targeted Player elects to forfeit the turn card 15 or claimed item, then the Trader takes the claimed item or turn card 15 and the Targeted Player continues the turn as the Trader. The decision to request a block card 30 is input to the processor 110 via connection means 200 by the player through the interactive display terminal 115 where a process 308 is then executed by the processor 110 at the central location 105. The processor 110 transfers the claimed item or turn card 15 from the Targeted Player to the Trader. The resulting change is then sent to all interactive display terminals 115, 130 and displayed to the players and ringmaster through the video display 125, 140.

The second option allows the Targeted Player to request a block card 30 from the processor 110. The decision to request a block card 30 is input to the processor 110 via connection means 200 by the player through the interactive display terminal 115 where a process 309 is then executed by the processor 110 at the central location 105. The processor 110 then selects a block card 30 based on the randomization previously described, and displays the block card 30 to all interactive display terminals 115, 130.

The block card markings 12 may be in the form of instructions previously disclosed. Successful execution of the block card markings 12 occurs when the Trader defeats the Targeted Player, the Trader successfully executes the block card markings 12, or the Targeted Player unsuccessfully executes the block card markings 12. Successful execution of the block card markings 12 results in the Trader taking the Targeted Player's turn card 15 or claimed item. The Targeted Player then continues the turn as the Trader. Once a Trader has successfully captured the same claimed item three times it may not be taken from the player thereafter.

The ringmaster determines if the block card markings 12 were executed successfully. The ringmaster inputs this information to the processor 110 via connection means 200 through the interactive display terminal 130 where a process 310 is then executed by the processor 110 at the central location 105. The processor 110 transfers the claimed item or turn card 15 from the Targeted Player to the Trader. The resulting change is then sent to all interactive display terminals 115, 130 and displayed to the players and ringmaster through the video display 125, 140. The processor 110 then assigns a successful capture to the Trader and claimed item and stores that information at the central location 105. Once a Trader has successfully captured the same claimed item three times, it may not be taken from the player thereafter. The resulting change is then sent to all interactive display terminals 115, 130 and displayed to the players and ringmaster through the video display 125, 140.

Unsuccessful execution of block card markings 12 occurs when the Targeted Player defeats the Trader, the Targeted Player successfully executes the block card markings 12, or the Trader unsuccessfully executes the block card markings 12. Unsuccessful execution of the block card markings 12 results in the Trader continuing the turn as the Trader and the Targeted Player retaining possession of the turn card 15 or claimed item.

The ringmaster determines if the block card markings 12 were executed unsuccessfully. The ringmaster inputs this information to the processor 110 via connection means 200 through the interactive display terminal 130 where a process 311 is then executed by the processor 110 at the central location 105. The processor 110 the assigns a successful challenge to the Targeted Player and claimed item and stores that information at the central location 105. Once a Targeted Player has successfully defended the same claimed item three times it may not be taken from the Targeted Player thereafter. The resulting change is then sent to all interactive display terminals 115, 130 and displayed to the players and ringmaster through the video display 125, 140.

Once a player has captured or successfully defended the same claimed item three times, it may not be taken from the player (hereinafter "three times rule protection"). In this situation, if a trader card 20 or block card 30 directs a player to a protected player who has captured or successfully defended the same claimed item three times, the protected player may direct the Trader to any unprotected player possessing an item. The Trader must attempt to take the claimed item held by the unprotected player, but challenges through block cards 30 are allowed. If a protected player freely gives up a claimed item, the player must start anew to establish three times rule protection. Processor 110 stores the number of times a player has successfully defended an item and thus designates through the video display 125, 140 the status of such claimed items.

Once the processes regarding the Targeted Player's options are complete, a process 312 is executed by the processor 110 at central location 105. The processor 110 sends an output to all interactive display terminals 115, 130, through connection means 200, which presents three options to the player continuing on as Trader: 1) take and open an unclaimed item; 2) take a claimed item or turn card 15 from another player that was not the most recent Targeted Player or Trader; or 3) request a new trader card 20 from the processor 110.

If the Trader elects to take and open an unclaimed item, then the Trader inputs the decision to the processor 110 via connection means 200 through the interactive display terminal 115 where a process 306 is then executed by the processor 110 at the central location 105. The processor 110 reveals non-disguised information related to the formerly unclaimed item to all players and the ringmaster through the video displays 125, 140. The processor 110 further updates the players and ringmaster to show that the player, or Trader, has claimed this particular item. Upon selection of the unclaimed item, the turn automatically ends and the processor 110 identifies the next Trader based on the previously determined order of turn cards 15 through updating the video displays 125, 140.

If the Trader elects to take a claimed item or turn card 15 from another player that was not the most recent Targeted Player or Trader, then the Trader inputs the decision to the processor 110 via connection means 200 through the interactive display terminal 115 where a process 305 is then executed by the processor 110 at the central location 105. The processor 110 then displays the identity of the Targeted Player to all interactive display terminals 115, 130 via connection means 200 and play continues as previously described.

If the Trader elects to request a new trader card 20 from the processor 110, then the Trader inputs the decision to the processor 110 via connection means 200 through the interactive display terminal 115 and process 313 is then executed by the processor 110 at the central location 105. The processor 110 then selects the next trader card 20 and sends the trader card 20 to the ringmaster interactive display terminal 130. The ringmaster accepts or rejects the trader card 20 on the ringmaster interactive display terminal 130 through input interface 135, which communicates via connection means 200 to the central location 105. If the ringmaster rejects the trader card 20 then a process 304 is executed by the processor 110 at the central location 105 and a new trader card 20 is sent to the ringmaster interactive display terminal 130. If the ringmaster accepts the trader card 20 then a process 303 is executed by the processor 110 at the central location 105 and the trader card 20 is sent to all player interactive display terminals 115. Play then continues as previously described.

There are two methods by which the game may come to an end. According to one method, the game ends after all unclaimed items are claimed. Once the last unclaimed item is claimed, a process 314 is executed by the processor 110 at the central location 105. The processor 110 sends an output to all interactive display terminals 115, 130 informing the players and ringmaster of the game's end. In the alternative method, after all unclaimed items are claimed, the player who claimed the first item may return the claimed item, making the item unclaimed. If that player declines, then the game is over. If the player who claimed the first item elects to return the item, that player may then attempt to take any claimed item from a Targeted Player that does not have three times rule protection. Play continues until a Trader claims the remaining unclaimed item.

If game time is a factor, the ringmaster or host may set a time limit. Once the time limit has expired, the processor 110 will display those players who have not claimed an item. The processor 110, already having determined the turn order and any subsequent trades, will display the player whose turn is next, and once all items are claimed, the game is over.

For items that were purchased through the online retailer, the processor 110 sends the required information necessary to claim the item from the online retailer to the Player who won that item via connection means 200 to that player's interactive display terminal 115.

In an alternative embodiment, the connection 200 to the central location 105 may comprise totally remote access to the central location 105, or may be a combination of a computer application or software downloaded to each remote terminal 115, 130 in order to communicate via connection 200 to the central location 105.

The preferred method for the item exchange and trader game is ideal for use at: baby showers; birthdays; bridal showers; business offices; business training, education, and promotion; casinos and gaming centers; cities; regions; states; nationalities; community associations; conventions; co-ops; counseling groups and applications; court offices; customer appreciation parties; cruise ships/river boats; dental offices; education and training; fantasy trading games; festivals; fire department/emergency response offices; government agencies; law enforcement; medical offices; motion picture themes; military; national/state parks; non-profit organizations; public and private schools; research centers; religious themes, education, and training; resorts; retreat centers; sports teams & events; tailgate parties; theme parks; youth organizations; weddings; formatting the game for multi-level competition including, but not limited to, local, regional, state, and national events; formatting the game for television or movie applications such as a televised game show; and international applications of all of the above.

The present method is described in terms of a preferred method. Those skilled in the art will recognize that other alternative methods of such a game may be used in carrying out the present method. Other aspects, features, and advantages of the present invention may be obtained from a study of this disclosure and the drawings, along with the appended claims.

I claim:

1. A gaming system for playing an item exchange game with at least three opposing players comprising:

a plurality of items;

a plurality of input terminals;

a plurality of display terminals; and a central computing device having a processing device and a memory device wherein said memory device stores a plurality of instructions, a set of turn cards having a turn card marking indicating a unique relative priority within the set of turn cards, a set of trader cards having instructional markings wherein said instructional markings comprise taking an unclaimed item, taking a claimed item from a first opposing player, or taking a turn card from said second opposing player; and a set of block cards having markings required to block a second opposing player from using a trader card to claim a turn card or an item;

wherein said computing device is capable of receiving an input from said a plurality of input terminals based on said turn card, said trader card, and/or said block card, executing said plurality of instructions based on said input, and displaying the outcome of said executing to said a plurality of display terminals.

2. A gaming system for playing an item exchange game with at least three opposing players comprising of claim 1 wherein at least of one said a plurality of items is a virtual item.

3. A gaming system for playing an item exchange game with at least three opposing players comprising of claim 1 wherein said memory device stores description of said plurality of items.

4. A method of playing an item exchange game using at least three opposing players, a plurality of items wherein unclaimed items of said plurality of items are disguised and claimed items of said plurality of items are not disguised, and a central computing device having a processing device and a memory device wherein said memory device stores a plurality of instructions, a plurality of descriptions of said plurality of items, a set of turn cards having a turn card marking indicating a unique relative priority within the set of turn cards, a set of trader cards having instructional markings selected from the group consisting of claiming an item from said plurality of said items, wherein said item is claimed or unclaimed, and claiming a turn card of an opposing player; and a set of block cards having markings required to block an opposing player from using a trader card to claim a turn card or a claimed item from said plurality of items, comprising:

a. randomizing said set of turn cards, said set of trader cards, and said set of block cards by said central computing device;

b. issuing a turn card from said set of turn cards to each said at least three opposing players;

c. determining the first player by said central computing device based on first priority as determined by said turn card marking indicating a unique relative priority within the set of turn cards;

d. issuing by said central computing device a first trader card from said set of trader cards to said first player;

e. changing, by said central computing device, a first unclaimed item into first claimed item if said first trader card indicates to claim said first unclaimed item of said plurality of said items and said first player then follows the instructional markings on said first trader card;

f. if the obtained trader card indicates to take a turn card or item from a first opposing player, then said first player following the instructional markings on the obtained trader card unless the first opposing player requests a block card from said central computing device out of said set of block cards and the conditional markings on the received block card are successfully executed by said first player;

g. if a second opposing player requests said first player's turn card or claimed item, then said first player selecting an action from the group of actions consisting of forfeiting the requested turn card; forfeiting the requested claimed item; and requesting a block card;

h. if a block card is requested, then determining whether the conditional markings on the received block card are unsuccessfully executed by said first player;

i. if the conditional markings on the received block card are unsuccessfully executed; then said first player i. taking a second turn card or second claimed item from a third opposing player;

ii. requesting a second trader card from said set of trader cards and repeating step (c); or iii. taking an item not claimed by another player and repeating step (b);

j. if the third opposing player unsuccessfully executes, then said first player doing nothing.

5. The method of claim 4 wherein said first and third opposing player are the same opposing player.

6. The method of claim 4 wherein said opposing player may not lose possession of said claimed item if said player successfully executes the conditional markings of the block card three times.

* * * * *